US010161136B2

(12) United States Patent
Underhill et al.

(10) Patent No.: US 10,161,136 B2
(45) Date of Patent: Dec. 25, 2018

(54) AUTONOMOUS ROOFING REMOVAL MACHINE

(71) Applicants: Mark James Underhill, West Falls, NY (US); Tyler Christian Underhill, West Falls, NY (US)

(72) Inventors: Mark James Underhill, West Falls, NY (US); Tyler Christian Underhill, West Falls, NY (US)

( * ) Notice: Subject to any disclaimer, the term of this patent is extended or adjusted under 35 U.S.C. 154(b) by 104 days.

(21) Appl. No.: 15/198,737

(22) Filed: Jun. 30, 2016

(65) Prior Publication Data

US 2017/0009458 A1 Jan. 12, 2017

Related U.S. Application Data

(60) Provisional application No. 62/189,876, filed on Jul. 8, 2015.

(51) Int. Cl.
*E04D 15/00* (2006.01)
*E01C 23/088* (2006.01)
*E01C 23/12* (2006.01)

(52) U.S. Cl.
CPC ..... *E04D 15/003* (2013.01); *E01C 23/088* (2013.01); *E01C 23/127* (2013.01)

(58) Field of Classification Search
CPC ..... E04D 15/003; B28D 7/005; E01C 23/088; E01C 23/127
USPC ..... 299/1.5, 39.6, 39.1, 39.4
See application file for complete search history.

(56) References Cited

U.S. PATENT DOCUMENTS 4,678,236 A * 7/1987 Wirtgen ..... E02F 7/04 299/1.5
5,607,205 A * 3/1997 Burdick ..... E01C 19/00 299/1.5
7,802,854 B1 * 9/2010 Lane ..... E04D 15/02 299/37.1
7,865,285 B2 * 1/2011 Price ..... E02F 3/434 172/4.5
9,782,915 B2 * 10/2017 Carlsson ..... B28D 1/045
2007/0164597 A1 * 7/2007 Brown ..... E04D 15/003 299/39.1
2010/0213295 A1 * 8/2010 Gould ..... B02C 18/2233 241/25
2013/0082507 A1 * 4/2013 Wachsmann ..... E01C 23/088 299/1.5
2014/0348584 A1 * 11/2014 Fritz ..... G05D 1/0214 404/72
2015/0117951 A1 * 4/2015 Schlenker ..... E01C 23/065 404/84.05
2015/0275444 A1 * 10/2015 Howe ..... E01C 23/12 299/39.6

* cited by examiner

*Primary Examiner* — David J Bagnell
*Assistant Examiner* — Michael A Goodwin
(74) *Attorney, Agent, or Firm* — Dunlap Bennett & Ludwig PLLC

(57) ABSTRACT

An autonomous guided roofing material removal machine is provided.

9 Claims, 4 Drawing Sheets

AUTONOMOUS ROOFING REMOVAL MACHINE

CROSS-REFERENCE TO RELATED APPLICATION

This application claims the benefit of priority of U.S. provisional application No. 62/189,876, filed 8 Jul. 2015, the contents of which are herein incorporated by reference.

BACKGROUND OF THE INVENTION

The present invention relates to construction equipment and, more particularly, an autonomous guided roofing material removal machine.

Roofing material removal is presently performed in a labor intensive manner using standard hand tools (roofing shovels, claw hammers, etc.). While there are some improved tools available, these tools require that human beings operate them while on the roof. For example, they use cumbersome rail guides or similar mechanical apparatuses. This presents significant safety and liability concerns and costs.

As can be seen, there is a need for an autonomous guided roofing material removal machine that eliminates manual labor, reducing liability in a dangerous profession.

SUMMARY OF THE INVENTION

In one aspect of the present invention, an autonomous guided roofing material removal machine includes a chassis providing mounting points; a propulsion system mounted to the chassis; a drum extending between a first end and a second end, wherein a distance between the first and second ends is approximately equal to a width of the chassis; a plurality of rows of removal teeth extending along the drum; a first and second height actuators, each height actuator interconnecting a respective end of the drum to the chassis so that the drum is moveable between a plurality of vertical profiles, wherein the drum is rotatably mounted between the first and second height actuators; a drum motor connected to the drum for selectively providing torque thereto; and a control system electronically connected to the first and second height actuators to controllably select at least one of the plurality of vertical profiles.

In another aspect of the present invention, the autonomous guided roofing material removal machine includes a chassis providing mounting points; a drum extending between a first end and a second end, wherein a distance between the first and second ends is approximately equal to a width of the chassis; a plurality of rows of removal teeth extending along the drum; a propulsion system mounted to the chassis, wherein the propulsion system further comprises an independent wheel drive disposed in board of the opposing ends of the plurality of rows of removal teeth; a first and second height actuators, each height actuator interconnecting a respective end of the drum to the chassis so that the drum is moveable between a plurality of vertical profiles, wherein the drum is rotatably mounted between the first and second height actuators; a drum motor connected to the drum for selectively providing torque thereto; a control system electronically connected to the first and second height actuators to controllably select at least one of the plurality of vertical profiles, wherein the control system is electronically connected to the propulsion system for remotely operating said propulsion system, wherein the control system is configured to receive a set of boundary conditions for delineating a boundary of operation when guiding the propulsion system, wherein the set of boundary conditions is selected from the group consisting of way points and rectangular bottom corners, and wherein the control system is electronically connected to the drum motor, and wherein the control system is configured to move the first and second height actuators in response to a torque condition of the drum motor, wherein the torque condition is the sudden increase of torque by a predetermined percentage; at least one video device physically connected to the chassis and electronically connected to the control system, wherein the control system is configured to use output of the at least one video device to guide the propulsion system; and an impact mechanism connected to the chassis, wherein the impact mechanism is operative during the torque condition.

These and other features, aspects and advantages of the present invention will become better understood with reference to the following drawings, description and claims.

DETAILED DESCRIPTION OF THE INVENTION

Figure 1:
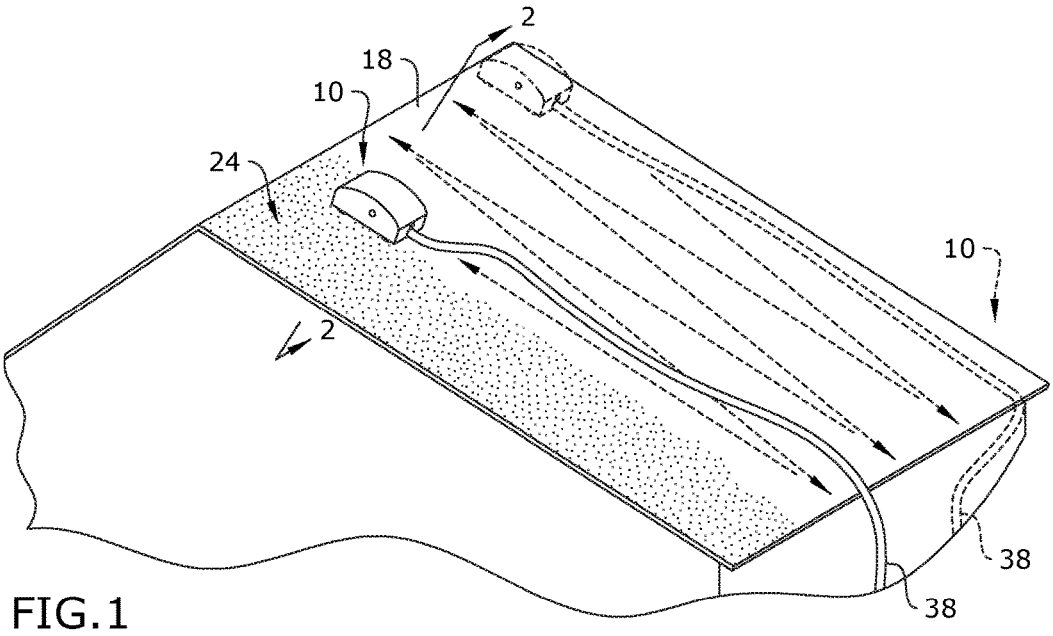
FIG. 1 is a perspective view of an exemplary embodiment of the present invention, shown using a predetermined pattern.
Figure 2:
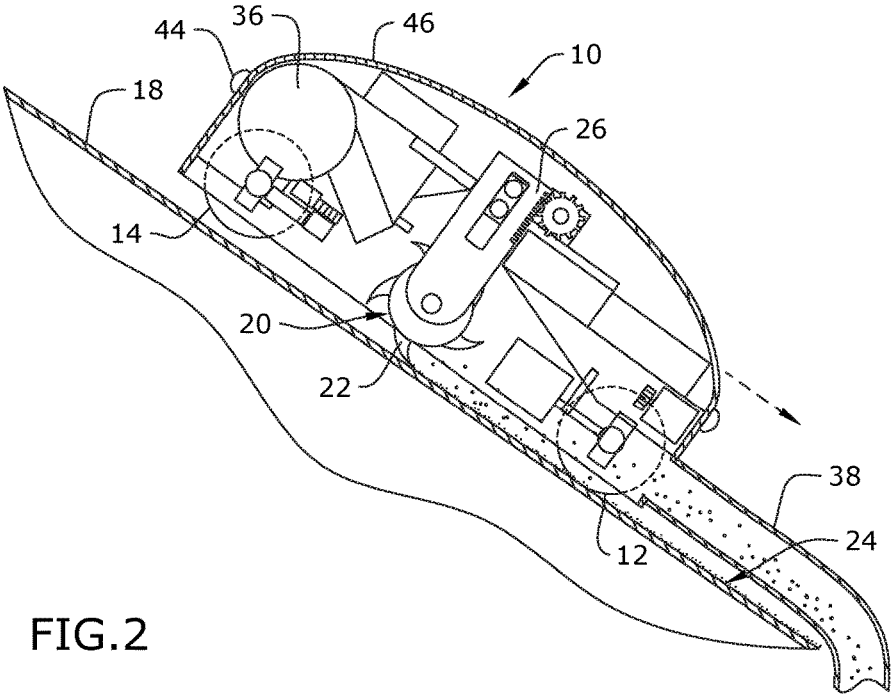
FIG. 2 is a section detail view of an exemplary embodiment of the present invention, taken along line 2-2 in FIG. 1.
Figure 3:
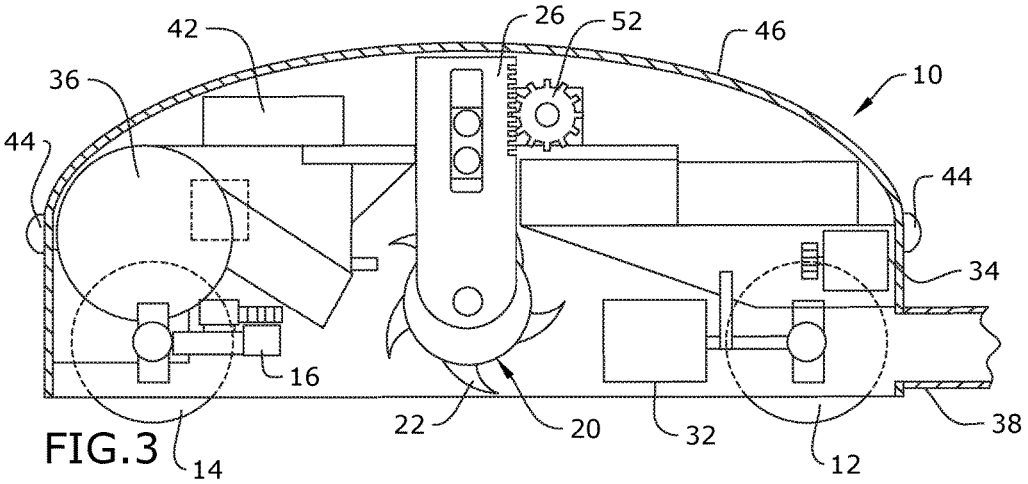
FIG. 3 is a section view of an exemplary embodiment of the present invention, demonstrating height actuator in raised position.
Figure 4:
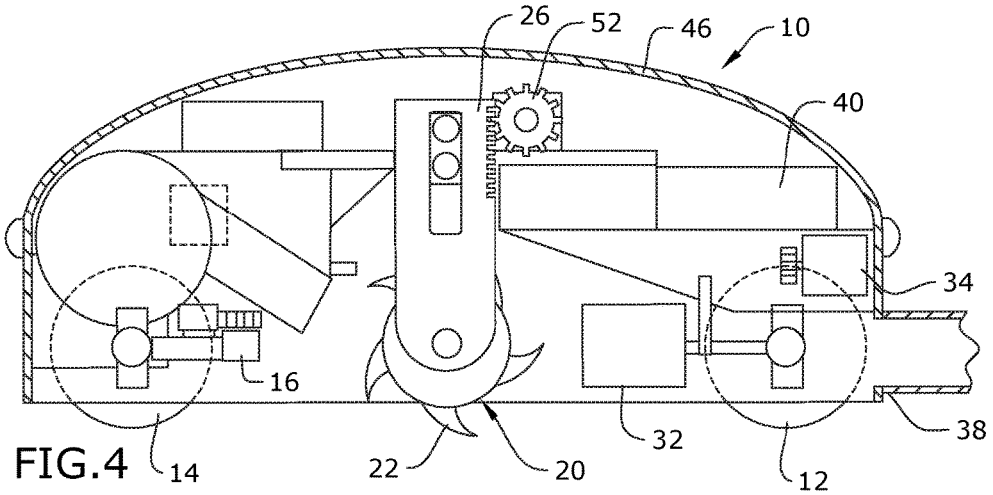
FIG. 4 is a section view of an exemplary embodiment of the present invention, demonstrating height actuator in lowered position.
Figure 5:
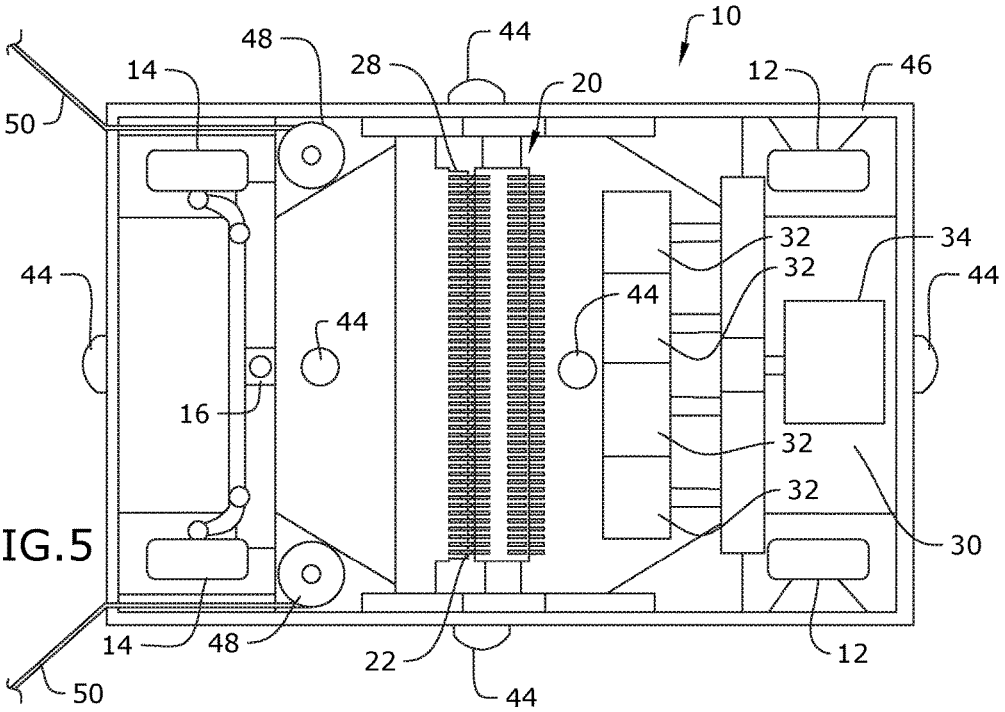
FIG. 5 is a bottom view of an exemplary embodiment of the present invention.
Figure 6:
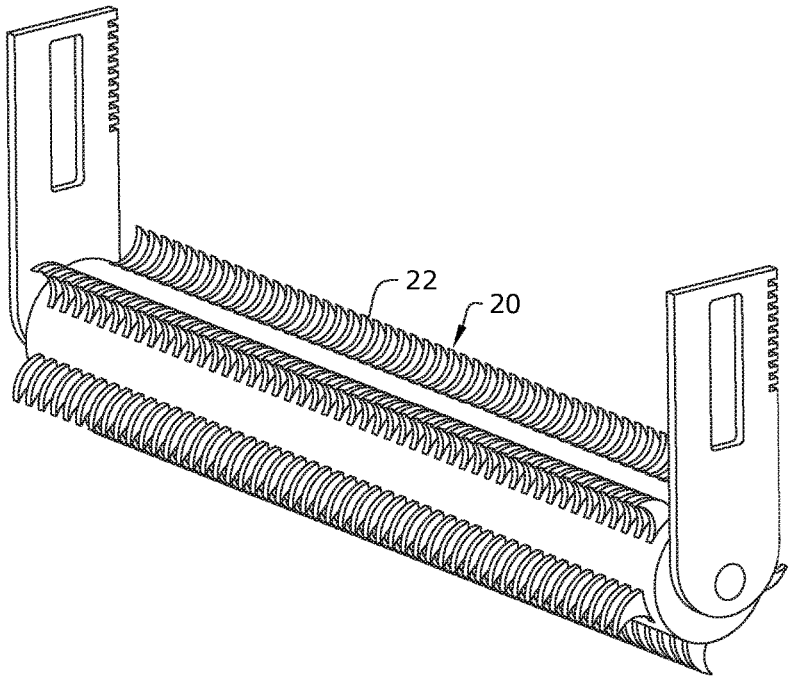
FIG. 6 is a perspective view of an exemplary embodiment of a cylindrical drum of the present invention.
Figure 7:
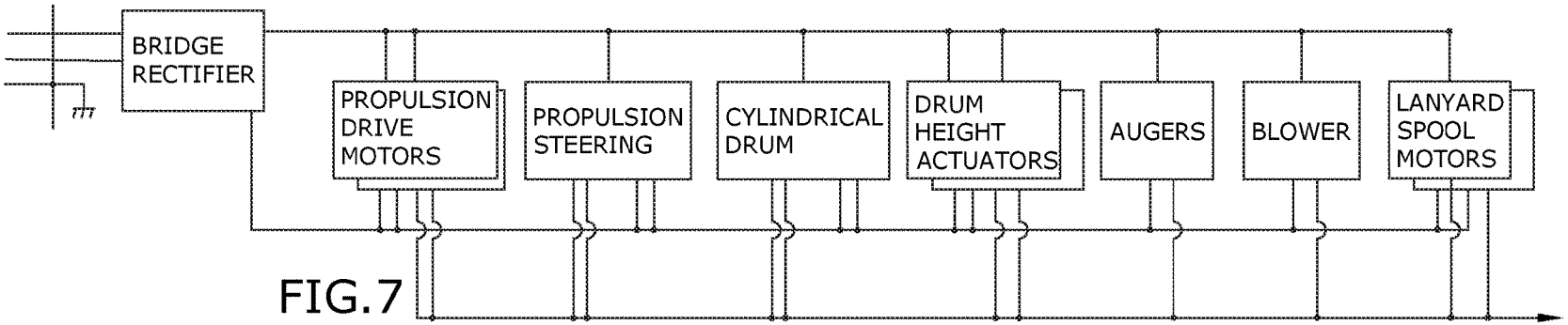
FIG. 7 is a simplified schematic of an exemplary embodiment of an electrical system of the present invention.
Figure 8:
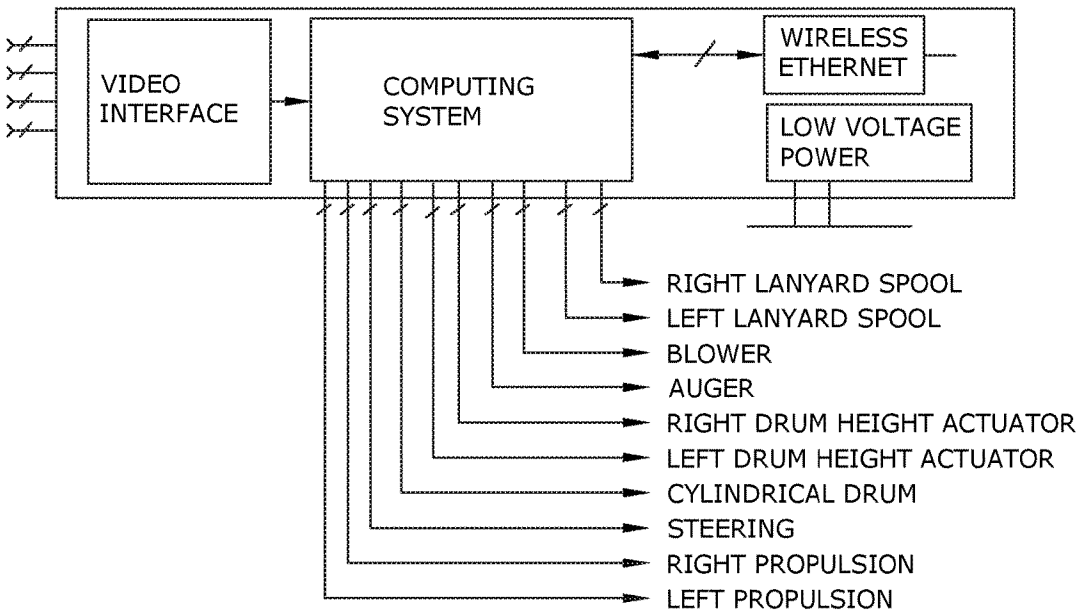
FIG. 8 is a simplified block diagram of an exemplary embodiment of a control system of the present invention.

The following detailed description is of the best currently contemplated modes of carrying out exemplary embodiments of the invention. The description is not to be taken in a limiting sense, but is made merely for the purpose of illustrating the general principles of the present invention.

Broadly, an embodiment of the present invention provides an autonomous guided roofing material removal machine that eliminates manual labor, reducing liability in a dangerous profession.

Referring now to FIGS. 1 through 8, the present invention may include an autonomous removal machine 10. The autonomous removal machine 10 may include a main chassis 46 whose primary purpose is to provide mounting points for the remaining elements of the machine. The main chassis 46 may be dimensioned and adapted to provide sufficient structural rigidity to support the autonomous removal machine 10 in operation. The main chassis 46 serves to protect the components of the autonomous removal machine 10 from the outside environment and users from the components. The main chassis 46 may be constructed from durable and resilient materials including but not limited to steel.

The autonomous removal machine 10 may include a propulsion system designed to allow the autonomous removal machine 10 to traverse roofs 18 safely and quickly. In the preferred embodiment, two fixed wheels 12 employ brushless DC style "hub" motors to provide the required drive torque to move the machine as commanded by the control system. Hub motor wheels may include the actual motor inside the hub of the wheel, allowing each wheel to operate independently or in concert with the other wheels. As such, if the autonomous removal machine 10 reaches a position with only one of its drive wheels in contact with the roof, control is retained. Two unpowered wheels 14 may be coupled with a rack and pinion steering system 16 so as to provide directional control as commanded by the control system via the steering motor. Directional control may be motor driven according to the commands issued by the computing/control system 42. The use of fixed, but independently controlled, rear wheels provide additional flexibility to allow the machine to maneuver as required by the target roof. In addition, all four wheels are mounted inside the main chassis 46 further in board than the extent of the removal mechanism (here a drum) in order to allow the removal mechanism to extend to the edge of a roof 18 without the vehicle risking falling over the edge. This also allows the autonomous removal machine 10 to clean roof valleys or ridges without special maneuvering. Alternates to this arrangement could include, but not be limited to, various drive and steering wheel combinations as well as tracked propulsion. Wheel combinations can include, but are not limited to, compliant composition contact surfaces or "spiked" wheels designed to grip the roof 18 in slippery or severely inclined situations.

The removal mechanism of the autonomous removal machine 10 may include a cylindrical drum 20 providing rows of "teeth" 22 designed to pull both roofing material 24 and/or nails from the roof surface as it rotates forward. In the preferred embodiment, the cylindrical drum 20 itself may be a direct drive, "inside out" brushless DC motor (i.e. the outside of the drum is the rotor and the inside is the stator). This is merely for the purposes of illustration and not by way of limitation, since it is likely that a geared system using an external motor to drive the drum is significantly less expensive. Alternatives include, but are not limited to, a chain drive, the aforementioned gear drive system, or alternate motor type (DC, induction, etc.). As a note, the drum itself may not necessarily be cylindrical, since it may be profiled externally to aid in roofing material 24 removal.

The cylindrical drum 20 via the drum height actuator 26 controlled through the processing adaptive algorithms of the electronically connected control system 42 is movable across a range of vertical drum profiles. In other words, as it rotates, the drum 20 is movable between lowered and raised positions as a function of a drum height actuator 26, in concert with a pinion gear 52, as illustrated comparatively in FIGS. 3 and 4. The distance of the cylindrical drum 20 from the roof 18 is controlled at each end by the drum height actuator 26 in order to provide the most efficient operation, to ensure the most efficient vertical drum profile is provided to remove roofing material 24 from the roof 18, whether a wheel is on the roof 18 proper or riding on roofing material 24 prior to removal. The row of teeth 22 may contact the previously cleaned portion of the roof, the cylindrical drum 20 is raised to provide an effective profile for removing shingles or nails. As the next row approaches, the cylindrical drum 20 may be lowered again in order to repeat this optimized vertical drum profile. This can be facilitated using a number of sensing alternatives well known in prior art.

Furthermore, the present invention provides a torque condition, whereby the vertical drum profile can be responsively moved when roofing fasteners (typically roofing nails) are engaged. Detection of the roofing fasteners can occur using a variety of methods; in the preferred embodiment, cylindrical drum 20 torque sensing (usually implemented by sensing motor current) is used to determine when a nail has been encountered. In use the torque condition, when the drum torque increases sufficiently, the control system 24, using the drum height actuators 26, pulls the nail or nails by exerting a vertical (pulling) force through urging an elevated vertical drum profile on a rotationally position locked cylindrical drum 20. The torque condition may be implemented with an increase of torque by a predetermined percentage, in certain embodiments, 100% normal operating torque. In the preferred embodiment, the machine's computing and control system 42 uses an adaptive algorithm to help hone the detection algorithm by learning the typical running torque for material removal without nails, enabling clearer decisions when torque increases due to nails. The algorithm also uses machine position feedback, obtained from propulsion system feedback, to predict the presence of nails based on their regular spacing. Position feedback, measuring the distance from the chassis to the previously cleaned roof surface, may also or alternatively be used to optimize the vertical drum profile. The autonomous removal machine 10 may also use, but not be limited to, metal detection or machine vision to assist in locating nails. In the preferred embodiment, the linear actuators are augmented using an impact mechanism adapted to reduce the peak forces required to pull nails.

Also the present invention provides a drum comb rail 28 adapted to prevent debris accumulation, especially nails, on the cylindrical drum 20. Under normal operation, the autonomous removal machine 10 rotates the cylindrical drum 20 through each set of teeth 22 using the described motion profile, removing material as each set of teeth 22 digs under the roofing material. Once each set of teeth 22 has performed its operation, the cylindrical drum 20 is reversed, causing the teeth 22 to pass through the comb rail 28. This removes any foreign matter, particularly nails, from the teeth 22.

The comb rail 28 causes the ejection of the material into the material removal system which may be positionable to collect the debris. The material removal system may include a rigid chute 30, a set of augers 32, an auger motor 34, a blower 36, and a flexible hose 38 that attaches to the rigid chute 30. It is used to break up the removed material and help force it down roof 18 into the collection system.

The rigid chute 30 may channel the removed material from the cylindrical drum 20 to the flexible hose that leads from the autonomous machine 10 to the ground collection container. This system allows the roof material debris, including nails, to be systematically disposed of without requiring a cleanup crew to laboriously clean debris from lawns and other ground surfaces. In the preferred embodiment, the collection system includes an electromagnetic system to sort nails from the debris as it is collected, providing an environmentally friendly source of additional revenue (i.e. the resulting scrap metal).

In order to ensure that the lifted roofing material is severed from the roof 18 and sufficiently pulverized, the auger system including the auger 32 and the auger motor 34 may be placed immediately after the cylindrical drum 20. As the material is lifted by the drum, it is engaged by the augers, torn from the roof, and efficiently propelled down the rigid chute into the flexible hose. The preferred embodiment uses four augers 32 to perform this task, although this example is merely for illustration and not by way of limitation.

An industrial blower 36 may be used to provide both downforce (suction) used to help keep the autonomous removal machine 10 properly positioned as well as positive pressure to blow removed material down the collection system. This is accomplished by providing a vacuum chamber at the top of the platform and ducts around the drum to ensure the removed material is forced into the collection system.

The electrical system 40 may receive electrical power using a common extension cord. This is merely for illustration and not by way of limitation, since alternatives such as battery power and an integrated portable generator are also viable. The electrical system 40 may rectify the received AC power into DC power (DC bus) for use by the previously denoted motors (propulsion system drive and steering motors, cylindrical drum drive, drum height actuator motors, blower motor, and auger system). In the preferred embodiment, the motors are expected to be brushless motors, but this is merely for illustration and not by way of limitation since alternate motor types could be used (brush, induction, stepper, etc.). Brushless motors require a controller to drive the motor; these controllers are powered from the common DC bus previously described. The DC bus also provides power to the computing and the control system 42 which may include battery backup in the preferred embodiment.

The present invention may include a set of video cameras 44 used for machine guidance (i.e. controlling the propulsion system) to include obstacle avoidance and trajectory planning, cylindrical drum motion profile optimization, and nail/fastener detection. The system utilizes four fixed video cameras, one for each direction of travel, as well as two located near the drum to observe operation. Alternative arrangements include, but are not limited to, a single directional camera mounted on a pan/tilt apparatus rather than the four fixed direction cameras, and alternate placement to observe drum operation. Each video camera 44 may also prove useful to ensure that the material removal system is not clogged. The present invention may use video or other sensors to ensure that material removal is proceeding efficiently and correctly, using techniques such as, but not limited to, edge detection, pattern recognition, or color recognition. The video imaging in the preferred embodiment uses visible light, but other vision systems, such as infrared, may be used either as the primary system or a form of augmentation.

The autonomous removal machine 10 may be under software control. The autonomous removal machine 10 may be initially lifted, typically using the same lift that is used to lift shingles, to roof level, then driven out on to the roof. Using the vision system and a video interface on the operator interface, the operator will designate the boundaries of the surface to be stripped, normally by identifying its corners (referred to as way points in machine vision). He will then arm the autonomous removal machine 10 and it may use its computing system and the vision system to plan out the most efficient stripping algorithm and methodically strip the old roofing materials 24. The software may be expected to coordinate the drive system, steering system, drum and drum height actuators, comb system, auger system, blower, and dual lanyard system if so equipped. Streaming video is expected to be delivered to both the operator interface and/or remote locations using an internet connection. Fault handling and monitoring functions will also be included to ensure safe autonomous operation.

The computing and control system 42 may execute the logical control required for autonomous operation. In the preferred embodiment, merely by way of illustration and not by way of limitation, it consists of a video processing engine for each video camera 44, a primary computing element (FPGA, microprocessor, or multiple microprocessors), and its associated support components, and a wireless video interface to the remote operator device. It also includes the interfaces to each motor and any additional sensors. The computing and control system 42 executes the software and firmware required to process the video information, command the various motors in coordination to most efficiently execute material removal, communicate using the wireless link, and perform safety, maintenance, and housekeeping tasks. The software, while consisting of modules based in prior art (machine vision, machine control, etc.), combines with the mechanical elements previously described to implement a novel machine. In order to further clarify, an example use is described (merely for the purposes of illustration and not by way of limitation) later in this document.

The machine control system may include safety features to ensure that it is safe to both operators and itself. These include, but are not limited to, an inclination sensing system that automatically prevents the machine from operating on roof regions with greater inclination than safety permits, unless the lanyard system is used.

For operation on heavily sloped roofs, a restraining system using a pair of cable spools/motors 48 mounted to the upper corners of the main chassis 46, may be employed. The cable spools/motors 48 are used to control the length of the cables 50 and therefore the position of the machine as it traverses the roof. The cable spools/motors 48 are controlled by the computing and control system, allowing the present invention to operate autonomously on severely sloped roofs. The term autonomously may translate to "without human input".

A method of using the present invention may include the following. The autonomous removal machine 10 disclosed about may be provided. A user may place the autonomous removal machine 10 at the bottom of the roof. In the preferred embodiment, the user may communicate from the ground using a wireless video link and designates way points (landmarks such as the left roof peak, the right roof peak, etc.) using a graphical tool (by circling them, for example, on a tablet display that is providing a specific camera view) that can be used by the machine to delineate its boundaries of operation. For example, when operating on a simple roof, the machine would normally use each of the top corners and each of the bottom corners to delineate the rectangular area to be cleared of roofing material. Once the way points were delineated, the operator would confirm the area to be cleared, then authorize the autonomous removal machine 10 to begin operation. The autonomous removal machine 10 would then plan an appropriate clearing pattern, drive to the starting point, and begin operation. The vision software, well known in prior art, could use the specific features associated with the designated way points to guide the machine. A typical pattern for a rectangular, featureless roof, is shown in FIG. 1. The operator may also designate a specific pattern using graphical software on the interface device.

Once the autonomous removal machine 10 has achieved the starting position, the computing system begins stripping material by rotating the drum under the roofing material. The drum height actuators 26 may be used to ensure the resulting drum contact profile is optimum. This would normally be done using a position sensor or the machine vision observing the drum operation. Once material is lifted, the auger system will tear into the lifted material, pulverizing it and sending it down the material chute. After each lift (or series of lifts if the drum has multiple finger ridges), the drum reverses and is cleaned by the cleaning comb bar. The entire autonomous removal machine 10 moves its pieces in concert, including the cylindrical drum 20, the drum height actuators 26, and the propulsion system, to lift, pulverize, and dispose of the old roofing material. The vision system 44 ensures that the machine stays on course until the initial area is stripped. Assuming the optimum pattern is down the roof 18, the present invention would then drive back to the top and begin on the next strip. This process, all under control of the computing system 42, proceeds until the task is completed, at which time the machine sends a DONE signal to the operator.

The present invention may also be controlled manually by the remote operator using the video feed and directional controls in the remote device. In this mode, the operator steers the present invention while initiating and monitoring the material removal system.

The object of the present invention includes an autonomous guided roofing material removal machine that eliminates manual labor; that operates autonomously (without human intervention, guidance, or control) to remove roofing material; that operates via remote control to remove roofing material; that uses machine vision to guide autonomous (without human intervention, guidance, or control) roofing material removal; that uses machine vision to designate landmarks and/or way points for use in autonomous (without human intervention, guidance, or control) operation; that uses machine vision to optimize roofing material removal; that uses machine vision to optimize roofing material removal using adaptive algorithms; that uses adaptive algorithms to optimize roofing material removal; that uses adaptive algorithms to optimize nail detection; that uses propulsion system position feedback to predict or assist in predicting the presence of nails; that provides real time video streaming to remote devices; that provides real time machine state information to remote devices; that uses an impact mechanism to reduce the force required to remove nails; that uses servo controlled lanyards to assist in positioning itself autonomously (without human intervention, guidance, or control); that uses servo controlled lanyards to assist in positioning via remote control; that uses negative pressure (i.e. reduced air pressure) to assist in maintaining or achieving desired positioning; that uses positive pressure to help force removed material into a collection system; that uses independent wheel drive to optimize traction and/or assist in steering, whose removal mechanism's span extends beyond the outer edge of its wheels.

It should be understood, of course, that the foregoing relates to exemplary embodiments of the invention and that modifications may be made without departing from the spirit and scope of the present invention.

What is claimed is:

1. A device, comprising:

a chassis;

a propulsion system mounted to the chassis;

a motor-driven drum extending between the chassis;

a plurality of rows of removal teeth extending along the motor-driven drum;

a first and a second height actuator mounted to the chassis, each height actuator moveable between a lowered and a raised position, wherein the motor-driven drum is rotatably mounted between the first and second height actuators;

a control system operatively associated to the first and second height actuators and the motor-driven drum, the control system configured to move said first and second actuators; and the control system configured to (a) sense a change in torque of the motor-driven drum and (b) move said first and second height actuators toward the raised position in response to the control system sensing a predetermined increase of said torque.

2. The device of claim 1, wherein the control system is operatively associated to the propulsion system for operating said propulsion system.

3. The device of claim 1, further comprising at least one video device physically connected to the chassis and electronically connected to the control system, wherein the control system is configured to use an output of said at least one video device to guide the propulsion system autonomously.

4. The device of claim 3, wherein the control system is configured to receive a set of boundary conditions that the control system uses for delineating a boundary of operation when guiding the propulsion system.

5. The device of claim 1, wherein a video system is used to recognize the presence or absence of roofing material and subsequently guide, control, and optimize the removal of said roofing material.

6. The device of claim 1, wherein the propulsion system further comprises at least two independently driven wheels.

7. The device of claim 6, wherein the at least two independently driven wheels are disposed inboard of opposing ends of the motor-driven drum.

8. The device of claim 7, further comprising at least one spool/motor mounted to the chassis for selectively controlling an associated cable so as to position the device on slippery or steeply inclined surfaces.

9. The device of claim 1, wherein the predetermined increase is 100%.

* * * * *